US006044747A

United States Patent [19]

Felts

[11] Patent Number: 6,044,747

[45] Date of Patent: Apr. 4, 2000

[54] SHARPSHOOTERS RIFLE REST

[76] Inventor: Jeffrey G. Felts, 6845 Woonsocket, Canton, Mich. 48187

[21] Appl. No.: 09/055,775

[22] Filed: Apr. 6, 1998

Related U.S. Application Data

[60] Provisional application No. 60/044,132, Apr. 22, 1997.

[51] Int. Cl.[7] ..... F41A 23/14

[52] U.S. Cl. ..... 89/40.06; 89/37.04; 42/94

[58] Field of Search ..... 42/94; 89/37.04, 89/40.06; 73/167

[56] References Cited

U.S. PATENT DOCUMENTS

| | | | |
|---|---|---|---|
| D. 203,680 | 2/1966 | Allison | 42/94 |
| 577,026 | 2/1897 | Heinrich . | |
| 1,211,130 | 1/1917 | Frateschi . | |
| 1,324,934 | 12/1919 | Shand | 42/94 |
| 2,589,039 | 2/1952 | Booth | 89/40.06 |
| 2,870,683 | 1/1959 | Wilson | 89/40.06 |
| 2,877,689 | 3/1959 | Pribis | 89/37.04 |
| 3,016,802 | 1/1962 | Grunenberg | 42/94 |
| 3,225,656 | 12/1965 | Flaherty et al. | 42/94 |
| 4,409,751 | 10/1983 | Goda et al. | 42/94 |
| 4,998,944 | 3/1991 | Lund | 42/94 |
| 5,070,636 | 12/1991 | Mueller | 73/167 |
| 5,347,740 | 9/1994 | Rather et al. | 42/94 |
| 5,497,575 | 3/1996 | Fried | 42/94 |

FOREIGN PATENT DOCUMENTS

| | | | |
|---|---|---|---|
| 860662 | 1/1941 | France | 89/40.06 |
| 682126 | 10/1939 | Germany | 89/40.06 |
| 3319 | of 1908 | United Kingdom | 42/94 |
| 630178 | 8/1947 | United Kingdom | 89/40.06 |

OTHER PUBLICATIONS 2 pg brochure, Paradise Ridge Machine., Tripod Rest 3809 Blaine Rd. Dept. SGN, Moscow, Idaho 83843.

Mercier, How Cartridges Are Made, American Rifleman, p. 12, May, 1948, .

Time Precision Inc., Rear Rest With Adjustable Windage and Elevation, 4 pages, Nov. 1996.

Bench Master, The Cadillac of Rifle Rests, 2 pages, 1989.

*Primary Examiner*—Stephen M. Johnson
*Attorney, Agent, or Firm*—Young & Basile, P.C.

[57] ABSTRACT

A firearm rest connectable to a tripod having vertically and longitudinally adjustable front and rear rest mounts and pivotally and longitudinally adjustable arm rests. The front and rear rest mounts and arm rests are selectively connectable to a base plate. The base plate has a plurality of rows of apertures therethrough for positioning threaded rods attached to the front and rear rest mounts. The arm rests have longitudinal slot for positioning the arm rests relative to the length of the gun and for receiving lock nuts which connect the arm rests to the base plate via the slots and apertures.

15 Claims, 2 Drawing Sheets

SHARPSHOOTERS RIFLE REST

This application claims the benefit of domestic priority under 35 U.S.C. 119(e) in regard to U.S. provisional application number 60/044,132; filed Apr. 22, 1997 now abandoned.

FIELD OF THE INVENTION

The present invention relates to a support for a firearm.

BACKGROUND OF THE INVENTION

Precision shooting is a growing industry. Precision shooters require a stable platform from which to fire their weapons. Many shooters such as hunters, military personnel, and specialized police units spend a substantial amount of time lying in wait to ambush a target once it appears. Conditions such as the shooters physical environment, terrain, and weather are important factors in determining the best shooting position. It is therefore beneficial for the shooter to be provided with an adjustable, lightweight shooting platform that provides mobility, comfort, versatility, and most importantly accuracy enhancement. Giving a shooter all of these attributes increases the possibility of success. Further, it is desirable to provide adjustable armrests to this platform so that the shooter has a stable position to rest his arms for balance and comfort while aligning and firing the weapon, since this platform can be used in the standing, kneeling, or sitting shooting positions. It is also useful to provide a clamping device which secures the weapon onto the platform for the shooters comfort, as well as, minimal movement by the shooters weapon while getting back into a firing position thereby reducing the possibility of alerting a potential target to the shooter's presence. In addition, it is desirable to provide a shooting platform that is compatible with a wide range of weapons, and that is completely adjustable to accommodate its user's personal shooting style and comfort.

SUMMARY OF THE INVENTION

A firearm support of the present invention includes a mounting plate capable of attachment to a tripod. The mounting plate also has a flat bottom surface for positioning on any flat horizontal surface when a tripod is unavailable or unnecessary. The mounting plate has a row of center apertures for adjustable attachment to tripods of various sizes. The center row of apertures located forward and rearward from the attachment to the tripod allows for adjustable connection to a cushioned rest bar for the front portion of a firearm and a release clamp for the butt end respectively. Rotational side arms are also provided and mounted to the mounting plate. The side arms provide a support for the user's arms during alignment and firing of the gun.

The firearm support of the current invention provides many advantages. The flexibility of the mounting positions allows for numerous weapon styles and sizes. The movable arm rests allow the shooter comfort as well as maneuverability. Set-up and dismantle of this support is quick and easy; and the compact package of the dismantled support provides easy transport to the firing site.

Other objects, advantages and applications of the present invention will become apparent to those skilled in the art when the following description of the best mode contemplated for practicing the invention is read in conjunction with the accompanying drawings.

BRIEF DESCRIPTION OF THE DRAWINGS

The description herein makes reference to the accompanying drawings wherein like reference numerals refer to like parts throughout the several views, and wherein.

DESCRIPTION OF THE PREFERRED EMBODIMENT

Figure 2:
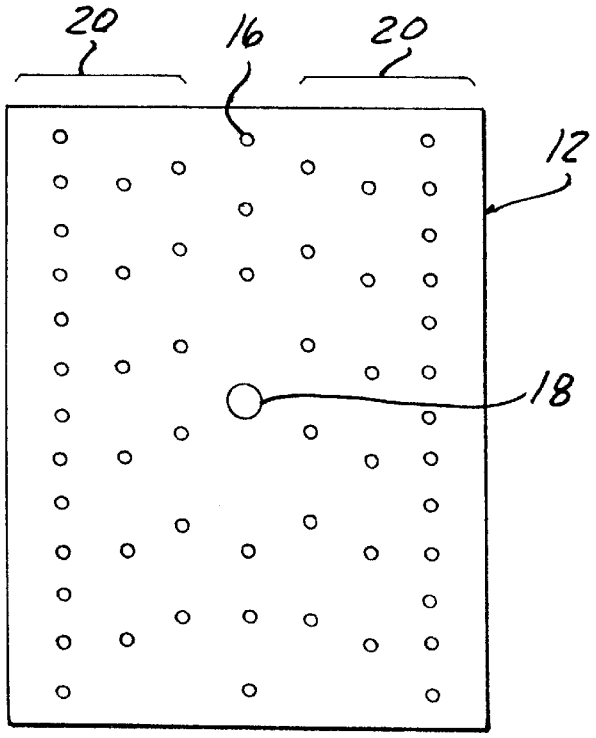
FIG. 2 is a plan view of a base plate of the rifle support.
Figure 3:
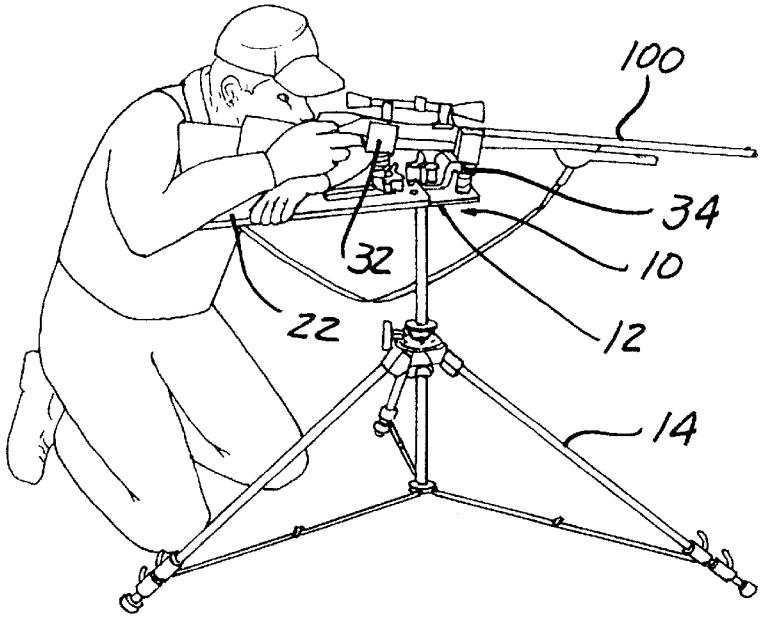
FIG. 3 is a side view of the rifle support installed on a tripod.

The firearm support 10 of the current invention includes a base plate 12 for releasable attachment to a tripod 14. The base plate 12 has seven rows of adjustment holes as seen in FIG. 2. The center row 16 is designed for tripod 14 attachment, and the gun rest mount adjustment. The center hole 18 of the center row 16 will accommodate a ⅜ inch stud screw 19 on a tripod 14. The holes in front and behind the center hole 18 in row 16 will accommodate a ¼ inch stud screw for other size tripods. Therefore, the appropriate hole can be used depending on the tripod and its attachment.

On either side of the center row 16 of adjustment holes are three additional rows of holes 20. These holes are for releasable and adjustable attachment of two armrests 22 to the base plate 12. Each armrest has a narrow front portion 19 having an inner edge 23 that tapers outwardly to a wide rear portion 21. Adjacent the front edge 25 of each armrest 22 are three adjustment apertures 24 for securing the armrest 22 to the base plate 12. Adjacent the three adjustment apertures 24 is an elongated adjustment slot that extends toward the wide rear portion 21 of the armrest. The slot 26 terminates before the inner edge 23 tapers. The elongated slot 26 allows for width adjustment of the armrests. The armrest 22 can be secured to the base plate 12 with lock nuts 28, by inserting a lock nut 28 into one of the three adjustment holes 24 to accommodate the desired length of the arm rest 22. Then another lock nut 28 can be placed through the elongated slot 26 of each armrest and into a corresponding off center hole 20 in the base plate 12.

Figure 1:
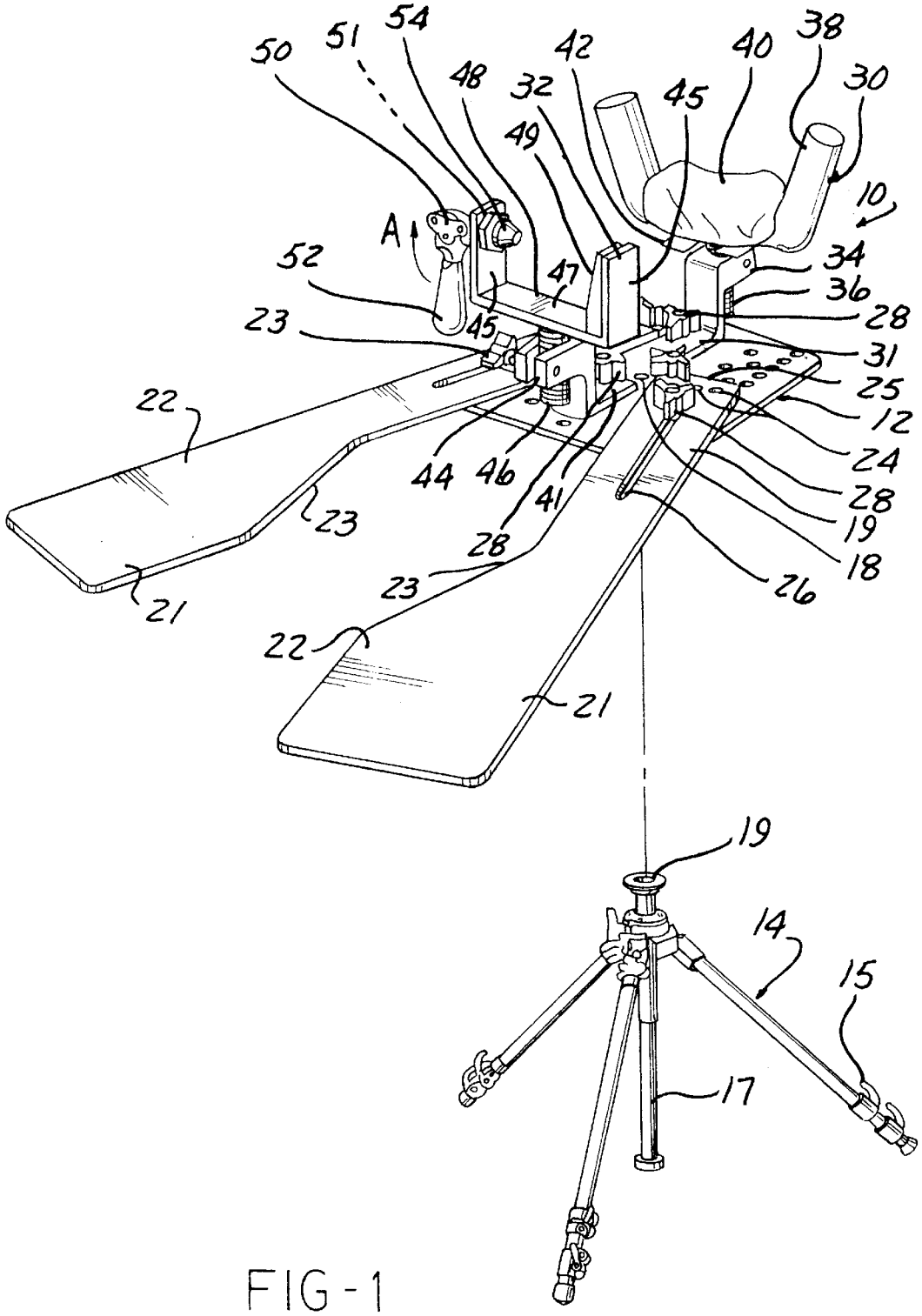
FIG. 1 is a perspective view of the rifle support according to the current invention.

In addition, this firearm rest 10 includes front and rear gun rest mounts 30, 32 respectively to accommodate the gun 100. The front gun rest mount 30 includes a heavy duty S-shaped bracket 34 having a lower surface 31 with a through aperture for releasable attachment to the base plate 12 with a lock nut 28. The S-shaped bracket 34 has an upper surface having a larger through aperture for receiving a threaded rod 36, attached to a cross arm 38 at one end. The cross arm 38 includes a pair of angled vertical supports spaced by a center horizontal support having a cushioning means thereon. The cushioning means may include a bean bag 40. The bean bag 40 may be selectively secured to the cross arm 38 by velcro attachments 42. The rear gun rest mount 32 includes another, essentially identical heavy duty S-shaped bracket 44 having a lower surface 41 with an aperture therethrough that receives a lock nut 28 to secure to the base plate 12. The S-shaped bracket 44 further includes an upper surface having a through aperture for receiving a another threaded rod 46 having one end secured to a second cross arm 48. The rear cross arm 48 includes two vertical supports 45 separated or spaced by a horizontal flat surface. An aperture 51 is located in one of the vertical supports of the rear gun rest 32. On the other vertical support, a cushion 49 is attached to the inside vertical support 45. A clamping device 50 is disposed within the aperture 51 of the rear gun rest 32. The clamping device 50 is pivotally connected at one end to a handle 52. The clamping device is further connected at its other end to a cushioned plunger 54. The plunger 54 is disposed within the aperture 51 of the vertical support 45 of the rear rest 32 such that the cushioned portion 54 of the plunger is exposed and directed toward the cushion 49. When the plunger 54 is in the retracted position, the handle 52 is located in the first vertical position, as shown in FIG. 1. By pivotally moving the handle 52 from its first vertical and rest position to a second vertical position (in the direction of arrow A), the clamping device 50 translates this pivotal movement to a horizontal movement of the plunger 54. Therefore, when the handle 52 is in the second vertical position the plunger 54 having its end exposed between the two vertical supports, is moved toward the cushioned portion 49 of opposing vertical support 45. The plunger 54 therefore then secures the weapon butt in position between the cushion end of the plunger 54 and the cushioned opposing vertical support.

The front and rear gun rest mounts 30 and 32, respectively, can be adjusted to fit the size of the gun 100. The gun rest mounts 30 and 32 can be moved forward or backward on the base plate 12 until the weapon 100 is comfortable resting thereon. Both the front and rear gun rest mounts 30 and 32 are attached to the base plate 12 in the ¼ inch apertures of the center row 16. Once the front and rear rest mounts 30 and 32 are at the desired positions the lock nuts 28 can be used to secure the rest mounts 30 and 32 to the base plate 12. The elevation of the gun rest can be adjusted by screwing the threaded rods 36, 46 of the S-shaped brackets 34 up and down with respect to the base plate 12 so that front and rear gun rests 30, 32 are at a point that best fits the gun 100 and the shooter. Once the rests 30, 32 are in the desired elevation they can be tightened down using the provided lock nuts 28 located on the upper portion of the S-bracket 34, 44.

The clamping device 50 on the rear gun rest 32 is used to lock the weapon 100 onto a primary target area should the user want to remove his hands from the gun 100. The plunger 54, or actual clamping device, is adjustable by screwing it into, or out of, the clamp handle. It is extremely important that the gun 100 is balanced proportionally on the gun rest 10, that the clamp 50 is properly adjusted to fit the gun 100, and that the clamp 50 is fully engaged and locked in place before the user removes his hands from the gun 100.

All of the basic fundamentals of marksmanship apply to the shooter who chooses to use the current invention. Fine elevation adjustments are made by raising or lowering the rear of the weapon. Windage adjustments can be made in one of two ways: Fine windage adjustments are accomplished by rotating the gun in the desired direction on the front gun rest 30. Secondly, one has the option to leave the front upper gun rest lock nut loose which enables the entire front gun rest to rotate allowing the shooter to track a moving target from a rested position. The bean bag 40 on the front rest 30 is not for placing the barrel of a gun 100 directly thereon, but is for receiving the fore end or hand guards of a gun on the bean bag 40.

This gun rest is lightweight and portable, weighing approximately five pounds and extending approximately seventeen inches by six inches when in its carrying configuration. This gun rest is completely adjustable to accommodate many different shooting positions and weapons.

While the invention has been described in connection with what is presently considered to be the most practical and preferred embodiment, it is to be understood that the invention is not to be limited to the disclosed embodiments but, on the contrary, is intended to cover various modifications and equivalent arrangements included within the spirit and scope of the appended claims, which scope is to be accorded the broadest interpretation so as to encompass all such modifications and equivalent structures as is permitted under the law.

What is claimed is:

1. A gun rest for positioning on a tripod and for receiving a gun thereon, comprising:

a mounting plate attachable to the tripod;

a front rest mount releasably connected to the mounting plate;

a rear rest mount releasably connected to the mounting plate; and adjustable arm rests releasably connected to an upper surface of the mounting plate.

2. The gun rest of claim 1 further including means for vertically adjusting the front rest mount relative to the upper surface of the mounting plate.

3. The gun rest of claim 1 further including means for vertically adjusting the rear rest mount relative to the upper surface of the mounting plate.

4. The gun rest of claim 1 wherein said gun has a longitudinal length, said gun rest further including means for pivotally adjusting lateral movement of the arm rests and means for longitudinally adjusting the arm rests along the longitudinal length of the gun.

5. The gun rest of claim 4, wherein the arm rests have longitudinally extending slots.

6. The gun rest of claim 1, wherein said front rest mount is elevated over the mounting plate by an S-shaped bracket.

7. The gun rest of claim 1, wherein the front rest mount has a generally U-shaped configuration and a centrally located cushioning means thereon.

8. The gun rest of claim 1, wherein each arm rest has a narrow portion that tapers outwardly to a wide portion for arm support.

9. The gun rest of claim 8, wherein the narrow portion of the arm rest has an elongated slot therethrough.

10. The gun rest of claim 1, wherein said front mount is elevated over the mounting plate by a bracket.

11. The gun rest of claim 1, wherein the mounting plate is attachable to the tripod having a stud screw measuring one of ⅜ inches and ¼ inch diameter.

12. The gun rest of claim 1, wherein the rear rest mount has a U-shaped configuration with a pair of vertical supports and a horizontal portion therebetween, said rear rest mount further includes a selectively extendable cushioned clamping device emitting from at least one of the vertical supports toward the opposing vertical support.

13. A gun rest for positioning on a tripod comprising:

a mounting plate attachable to the tripod;

a front rest mount releasably connected to the mounting plate;

a rear rest mount releasably connected to the mounting plate;

adjustable arm rests releasably connected to the mounting plate; and attachment means for connecting the front and rear rest mounts and arm rests to the mounting plate, wherein the mounting plate has a plurality of rows of apertures therethrough for receiving the attachment means.

14. A gun rest for positioning on a tripod comprising:

a mounting plate attachable to the tripod;

a front rest mount releasably connected to the mounting plate;

a rear rest mount releasably connected to the mounting plate; and adjustable arm rests releasably connected to the mounting plate, wherein the rear rest mount has a U-shaped configuration with a pair of vertical supports and a horizontal portion therebetween, said rear rest mount further includes a selectively extendable cushioned clamping device emitting from one of the vertical supports toward the opposing vertical support.

15. The gun rest of claim 14, wherein the opposing vertical support has an inner cushioned surface.

* * * * *